United States Patent [19]

Newland et al.

[11] 4,107,806

[45] Aug. 22, 1978

[54] ANCHORING DEVICE

[76] Inventors: Robert Andrew Newland; Wallace Richard Leeke, both of Watsons Ln., Newrybar, New South Wales, 2479, Australia

[21] Appl. No.: 791,248

[22] Filed: Apr. 27, 1977

[30] Foreign Application Priority Data

Oct. 28, 1976 [AU] Australia ..... 7921/76

[51] Int. Cl.[2] ..... A63C 15/06

[52] U.S. Cl. ..... 9/310 E; 105/480; 105/483; 403/165

[58] Field of Search ..... 9/310 E; 24/115 K, 265 CD; 105/483, 480; 403/164, 165

[56] References Cited

U.S. PATENT DOCUMENTS

| | | | |
|---|---|---|---|
| 2,633,375 | 3/1953 | Wilcoxon | 403/165 |
| 2,843,060 | 7/1958 | Sladek | 105/483 |
| 3,233,319 | 2/1966 | Jensen et al. | 105/480 |
| 3,802,011 | 4/1974 | Castagnola | 9/310 E |

*Primary Examiner*—Trygve M. Blix
*Assistant Examiner*—Stuart M. Goldstein

[57] ABSTRACT

This invention relates to an anchoring device to be contained within and cemented into a cavity formed in a surfboard, this device comprising a housing having a recessed and an axially rotatable post, the post having an exposed end which is adapted for the attachment of an anchoring cord. Preferably, rolling element bearings are provided in order to ensure free rotation of the post.

4 Claims, 2 Drawing Figures

ANCHORING DEVICE

This invention relates to an anchoring device for securing a cord such as a leg-cord to a surfboard or the like.

Surfboard riders often secure a leg-cord to their surfboard so that the latter can be tied to their legs by a length of elastic cord. As the bottom of the surfboard must be substantially flat for easy passage through the water and the top of the surfboard must be flat to provide an unobstructed surface on which the surfer can stand, the cord preferably should be attached to the surfboard internally thereof. It is not practical to mould a cord into a surfboard, as such a cord would not be easy to replace. It is also necessary that the cord may be readily removed or secured as desired, as different cords are attached to the board to suit different surfing conditions. Furthermore, in the manufacture of surfboards having a built-in cord securing device, it is necessary that such devices or at least the metallic portions thereof, do not protrude beyond the board surface and hinder sanding operations on the board during manufacture.

Accordingly, this invention aims to provide an anchoring device which will enable a cord to be removably secured to a surfboard and in which the cord retaning device will be in use anchored internally of the board so as to provide an unobstructed outer surface. Other objects and advantages of the invention will become apparent from the following description.

SUMMARY OF THE INVENTION

With the foregoing and other objects in view, this invention resides broadly in an anchoring device adapted to be contained within and cemented into a cavity formed in a surfboard, said device comprising a housing having a recess which in use is open to the exterior of said housing, said post having an exposed end disposed wholly within said recess and adapted for attachment of an anchoring cord.

Preferably, rolling element bearing means are provided to ensure free rotation of said post.

Preferably also, the housing is made in the form of a plug which may be inserted into an aperture in the object and secured thereto as by cementing. It is also preferred that the base of the plug includes an outwardly projecting portion having a diameter smaller than the circular outer end of the plug whereby it may be inserted and cemented securely within a circular recess formed in the surfboard or the like and having a diaeter similar to the diameter of said outer end whereby the circular outer end may fit neatly within said circular recess.

DESCRIPTION OF THE DRAWINGS

In order that the invention may be more readily understood and put into practical effect, reference will now be made to the accompanying drawings which illustrate the preferred embodiment of the invention and wherein.

DETAILED DESCRIPTION

Figure 1:
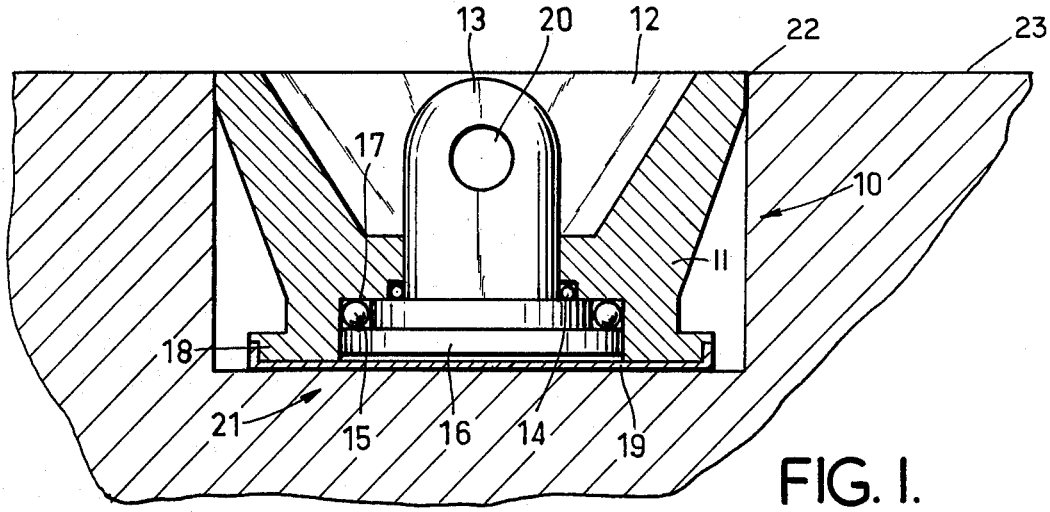
FIG. 1 illustrates a cross-sectional view of one embodiment of the invention.

As shown in FIG. 1, the basic form of the device 10 comprises a plastic body 11 having circular transverse cross-sections throughout and a frusto-conical recess 12 disposed co-axially with a rotatable metal post 13 which is preferably formed of stainless steel and which is apertured at its outer end at 20. The base of the post 13 is stepped outwardly in two stages, one, to accommodate an O-ring seal 14, and the other, to accommodate a plurality of stainless steel ball bearings 15. The base 21 of the housing 11 is correspondingly stepped to receive the O-ring seal and the bearings.

The bearings assembly operates as a thrust bearing between the lower flange 16 of the post 13 and the back face of the internal recess 17 to ensure free rotation of the post 13 even under high load conditions. The housing 11 is further provided with an external peripheral recess on its outwardly projecting base flange 18 to receive a clip-on cover plate 19, also suitably formed of plastic. This arrangement in use ensures that twist in the leg-cord will be released so that the cord will be able to operate normally to perform its desired function.

The outer surface of the device 10 is shaped as shown having an outwardly projecting base flange 18 of smaller diameter than the circular outer end 22 to permit the plug to be inserted base-first into a circular recess in the board 23, the recess having a diameter substantially equal to the diameter of the outer end 22, whereupon the outer end 22 of the in-position plug will fit neatly in the formed circular recess in the board. The outer surface of the plug tapers inwardly from its outer end to provide a space for cement which will fill in the void therebetween and when set form an abutment against which the base flange 18 will be fixedly retained. The aperture upper end of the post 13 also permits co-operation with a locking device whereby the board may be securely locked to a car or the like. For this and other purposes, more than one device could be provided, say one adjacent each end of the board.

Figure 2:
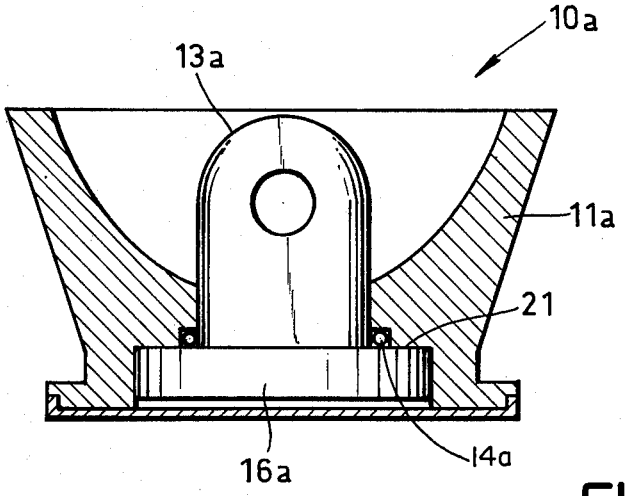
FIG. 2 illustrates a further embodiment of the invention.

The device **10*a* illustrated in FIG. 2 is similar to the device 10 illustrated in FIG. 1 except in that the flanged post 13*a* is moulded of plastic and the base is not stepped to provide a housing for the thrust ball bearing. A plain direct-contact bearing arrangement is utilised in this embodiment. The seal 14*a* is incorporated for the same function as in the previous embodiment to prevent ingress of sand or other foreign material into the bearing area 21 between the lower flange 16*a* and the housing 11*a***.

In use, a hole is drilled into the board having a diameter just greater than the diameter of the outer end of the housing 11, and a depth, where practical, equal to the depth of the housing. The device 10 is then inserted base first into the hole and a cement is added to fill the void between the cylindrical hole and the frusto-conical surface of the body 11. The cement may, for example, include fibreglass reinforcing as desired. When the cement has bonded securely to the internal surface of the hole and the device 10 the wedge-shape portion of the device will combine with the adhesive qualities of the adhesive to prevent extraction of the device from the board.

The body portion 11 is preferably made so that it protrudes beyond the post 13 and is of an easily sandable plastic material so that it may be sanded smooth with the outer surface of the board.

Of course, the housing may be made in shapes other than as shown and could be moulded in during construction of the board. It could be box-shaped and the outer sides would be rippled to assist retention within an object. The externally accessible recessed end may be dished other than concave shaped, and the post 13 may be of different form and may be adapted to co-operate with a mechanical locking device.

Of course, while the above has been given by way of illustrative example, it will be appreciated that many modifications of constructional detail and design may be made thereto by persons skilled in the art without departing from the broad scope and ambit of the invention as is defined in the appended claims.

We claim:

1. An anchoring device adapted to be contained within and cemented into a cavity formed in the topside of a surfboard and including, a hollow body part arranged substantially symmetrically about a central normally vertical axis; a post having its upper end apertured for connecting a cord or the like thereto and supported co-axially and rotatable within and by said body part for rotation about said axis and said part being substantially symmetrical thereabout; an outwardly radially extending base flange on said post to prevent retraction of said post through said body part in an upwards direction, and an outwardly radially extending annular locating flange about the lower end of said body part, said locating flange having an outer diameter not greater than the outer diameter of the upper end of said body part, the upper interior face of which is dished inwards from the surface of the surfboard in the direction of the lower end of said post, forming a hollow surrounding said upper apertured end of said post.

2. An anchoring device according to claim 1, wherein an O-ring seal is operatively supported between said post and said housing to prevent ingress of foreign matter from said hollow to said annular base flange.

3. An anchoring device according to claim 2, wherein said post is formed of stainless steel and said housing is formed of a plastic material.

4. An anchoring device according to claim 3, wherein the upper face of said annular base flange constitutes the lower raceway of a rolling element thrust bearing assembly, the upper face of which is constituted by an annular face of said body part concentric about said axis.

* * * * *